US009546463B2

(12) United States Patent
Do Nghia

(10) Patent No.: US 9,546,463 B2
(45) Date of Patent: Jan. 17, 2017

(54) SELF-CLEANING APPARATUS FOR THE PREVENTION OF MARINE GROWTH

(75) Inventor: Christopher Do Nghia, Selangor Darul Ehsan (MY)

(73) Assignee: IEV Group SDN. BHD (MY)

( * ) Notice: Subject to any disclaimer, the term of this patent is extended or adjusted under 35 U.S.C. 154(b) by 485 days.

(21) Appl. No.: 14/130,199

(22) PCT Filed: Jul. 1, 2011

(86) PCT No.: PCT/MY2011/000165

§ 371 (c)(1),
(2), (4) Date: Dec. 30, 2013

(87) PCT Pub. No.: WO2013/006023

PCT Pub. Date: Jan. 10, 2013

(65) Prior Publication Data

US 2014/0130273 A1 May 15, 2014

(51) Int. Cl.

| | |
|---|---|
| ***B63B 59/08*** | (2006.01) |
| ***E02B 17/00*** | (2006.01) |
| ***B63B 59/06*** | (2006.01) |
| ***B63B 59/04*** | (2006.01) |
| ***B08B 1/04*** | (2006.01) |

(52) U.S. Cl.

CPC ..... *E02B 17/0034* (2013.01); *B08B 1/04* (2013.01); *B63B 59/04* (2013.01); *B63B 59/06* (2013.01); *B63B 59/08* (2013.01)

(58) Field of Classification Search

CPC ..... B63B 59/04; B63B 59/06; B63B 59/08; B63B 2059/087; B08B 1/00; B08B 2059/082

USPC ..... 15/104.2, 159.1–160; 114/222

See application file for complete search history.

(56) References Cited

U.S. PATENT DOCUMENTS

| | | | | |
|---|---|---|---|---|
| 5,026,212 A * | 6/1991 | Do | E02B 17/0017 405/195.1 |
| 5,765,968 A * | 6/1998 | Lee | B08B 1/00 15/104.04 |
| 2003/0005874 A1* | 1/2003 | Miyoshi | B08B 1/00 114/222 |

FOREIGN PATENT DOCUMENTS

| | | | | |
|---|---|---|---|---|
| JP | 60-018492 A | 1/1985 | | |
| JP | 02-045295 A | 2/1990 | | |
| KR | 20-2009-0011819 U | 11/2009 | | |
| WO | 86/02612 A1 | 5/1986 | | |
| WO | WO 2008/123761 A1 * | 10/2008 | ..... | B63B 59/04 |

OTHER PUBLICATIONS

International Search Report, International Application No. PCT/MY2011/000165, mailed Mar. 21, 2012.

* cited by examiner

*Primary Examiner* — Laura C Guidotti
(74) *Attorney, Agent, or Firm* — Berenato & White, LLC

(57) ABSTRACT

An ocean surface-driven apparatus (1) to be installed around structural marine components comprising at least one ring wherein said ring comprising a plurality of rollers (2) disposed on a plurality of roller shafts (3) which are linked together by connectors (4). A plurality of linking members (5) with at least one moving self-cleaning ring (6) disposed on each linking member, said linking members linking a plurality of rings together.

20 Claims, 7 Drawing Sheets

SELF-CLEANING APPARATUS FOR THE PREVENTION OF MARINE GROWTH

CROSS-REFERENCE TO RELATED APPLICATION AND CLAIM TO PRIORITY

This application is a National Phase of International Application No. PCT/MY2011/000165 filed Jul. 1, 2011, which is incorporated herein by reference and to which priority is claimed.

TECHNICAL FIELD

This invention relates to new inventive designs of a range of self-cleaning and durable components for marine growth combating apparatus that harnesses natural ocean forces such as tidal fluctuations, swells, waves and currents to control and combat marine growth affecting offshore structures like jetties, oil and gas facilities, offshore wind farms and the like, by preventing marine growth that occurs on submerged structures.

BACKGROUND ART

Apparatus driven by ocean waves for cleaning and preventing marine growth like barnacles on offshore structures and maintaining the structures free of marine growth is available in the market. This apparatus comprises at least one ring used individually or in a series held together with linking members to form a cage. These apparatus are normally designed to be positively buoyant so they can respond to ocean energy. The wave driven device is driven by a combination between tidal fluctuation, waves and swells while the current driven apparatus is driven downward by current forces and resurfaces when there is a lack of current due to its buoyancy.

Although effective, the apparatus nevertheless has a limited operating life span due to settlement of marine organisms on the apparatus themselves. While the components that make continuous contact to the structure can keep themselves cleaned of marine growth such as rollers, other components such as connector assemblies are subject to marine growth colonization and hereinafter defined as non self-cleaning components. These have to be coated with anti-fouling coatings and once the life of anti-fouling coating is expired, marine growth starts to settle and gradually build up to the level whereby the buoyancy of the apparatus is compromised and the product will sink and no longer be operational.

One of the most common wear and tear is the premature breakage of the connectors at the pivotal connection. This is due to the rotation of the connectors as the product is driven under ocean forces over a long period. The operating life span of the apparatus is also further reduced when these structures are operating in rough sea areas such as in typhoon prone areas. The breakage of the connectors will compromise the integrity of the apparatus.

DISCLOSURE THE INVENTION

Therefore an object of this invention is to design a multiple-angle fixed connector assembly that eliminates the pivotal connection and the above-mentioned wear and tear problems. As the connector assembly is a non-self cleaning component, it has to be designed to allow for the free movement of self-cleaning aids while the apparatus operates. The connector shall preferably be moulded to predetermined angles to suit the required circumference of the protected structure and shall preferably be constructed from an abrasion and impact resistant plastic material, such as High Density Poly Ethylene and the like. In the case that the connector assembly connects linkage shafts or pipes in more than one planes, the connector assembly can be designed with multiple arms to connect shafts on horizontal plane and pipe on vertical plane.

It is another object of the present invention to overcome the above disadvantages of the current ocean driven apparatus by introducing a number of mechanical self-cleaning aids to the apparatus to remove the need to apply anti-fouling coating to non-self-cleaning components. The first cleaning aid will be in the form of a ring which is described as a disc that slides back and forth randomly over the connector assembly during the apparatus operation. The relative movement of the self-cleaning disc on the connector will prevent the settlement of marine growth on not only the connector body but also the sides of the two adjoining rollers as well as itself. The disc also plays a part in cleaning the structure and itself in the process. It also prevents the connector from having direct impact against the structure and subject to premature damage. The disc could also be made from composite rubber as opposed to high density polyethylene (HDPE) or a combination between a HDPE core and composite rubber, depending upon its applications, cleaning and/or prevention. One or more self-cleaning discs may be deployed to keep the entire connector assembly clean and withstand impact during the life of the apparatus.

To prevent marine growth from settling on other parts of the assembly, where the mechanical movement of the self-cleaning disc is not permitted by the geometry of the assembly, fixed self-cleaning rings will be used. The fixed self-cleaning ring is in the form of a ring with long and soft Nylon or other bristles that can be used to enhance the cleaning effectiveness of the assembly. The constant sweeping motion of bristles over the surface of the assembly would present the settlement of marine organisms on the surface of the assembly.

BRIEF DESCRIPTION OF THE DRAWINGS

In order to understand the invention clearly, hereinafter will be described certain preferred embodiments thereof, by way of example only and with reference to the accompanying drawings in which.

DESCRIPTION OF REFERENCE NUMERALS

Figure 1:
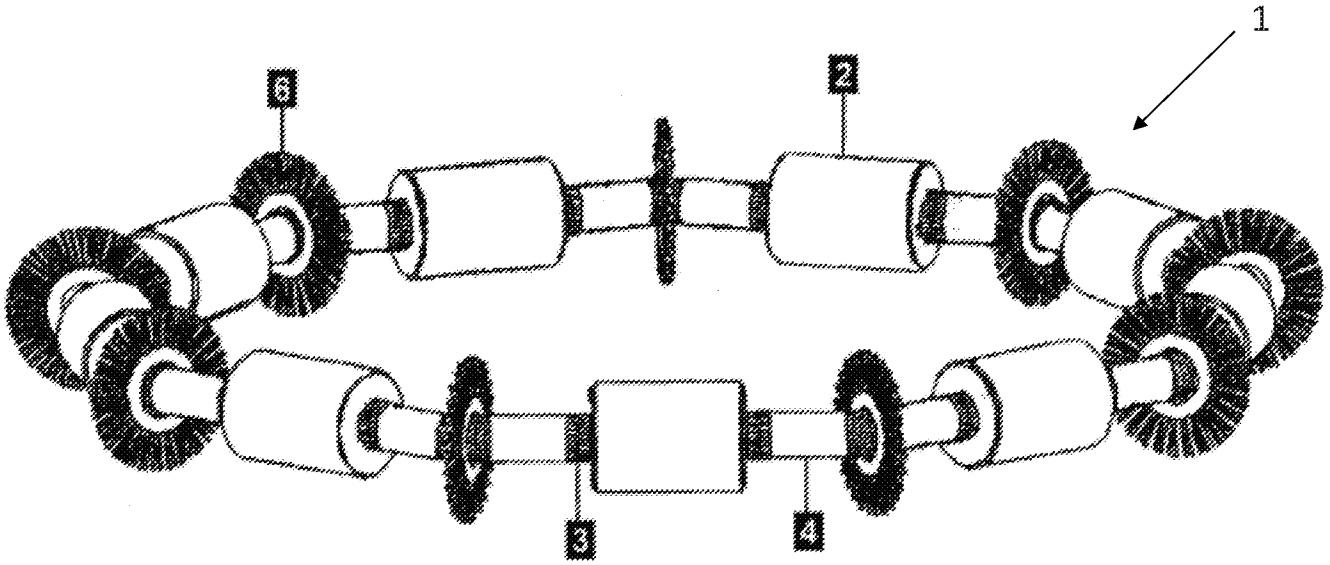
FIG. 1 shows an isometric view of an embodiment of a single ring collar apparatus used for marine growth prevention and to withstand impact according to the present invention.
Figure 2:
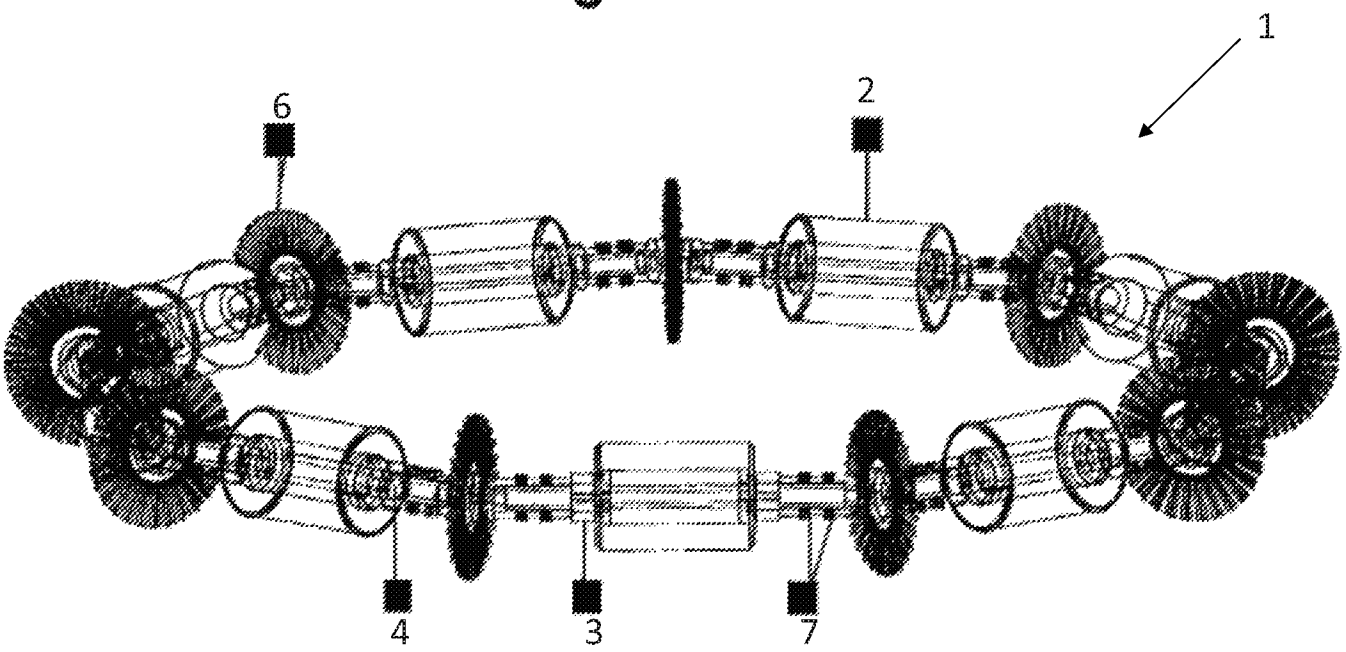
FIG. 2 shows a translucent isometric view of an embodiment of a single ring collar apparatus used for marine growth prevention and to withstand impact according to the present invention.
Figure 3:
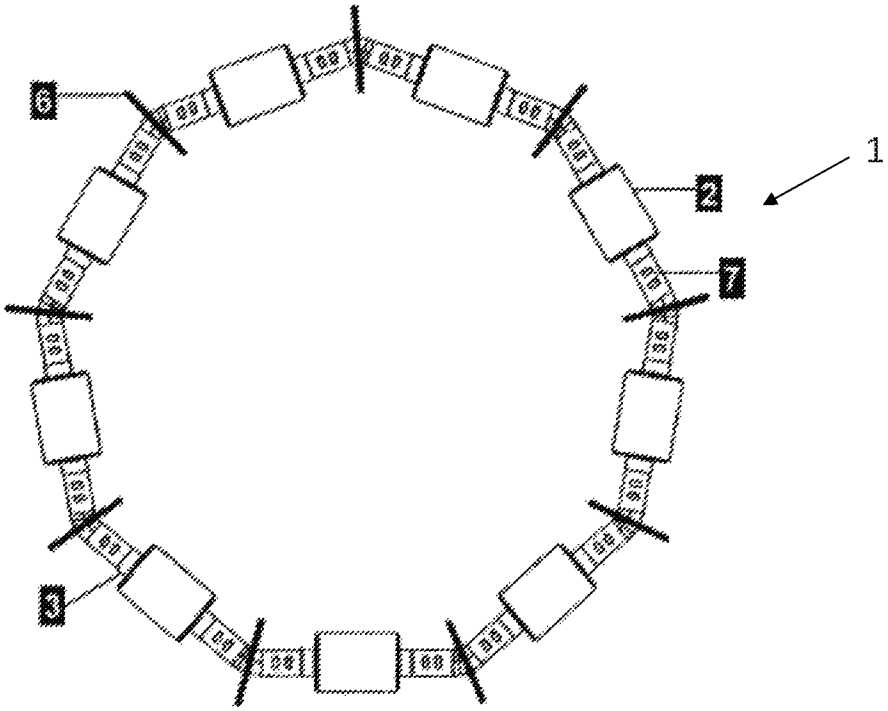
FIG. 3 shows the plan view of a single ring collar apparatus used for marine growth prevention and to withstand impact according to the present invention.
Figure 4:
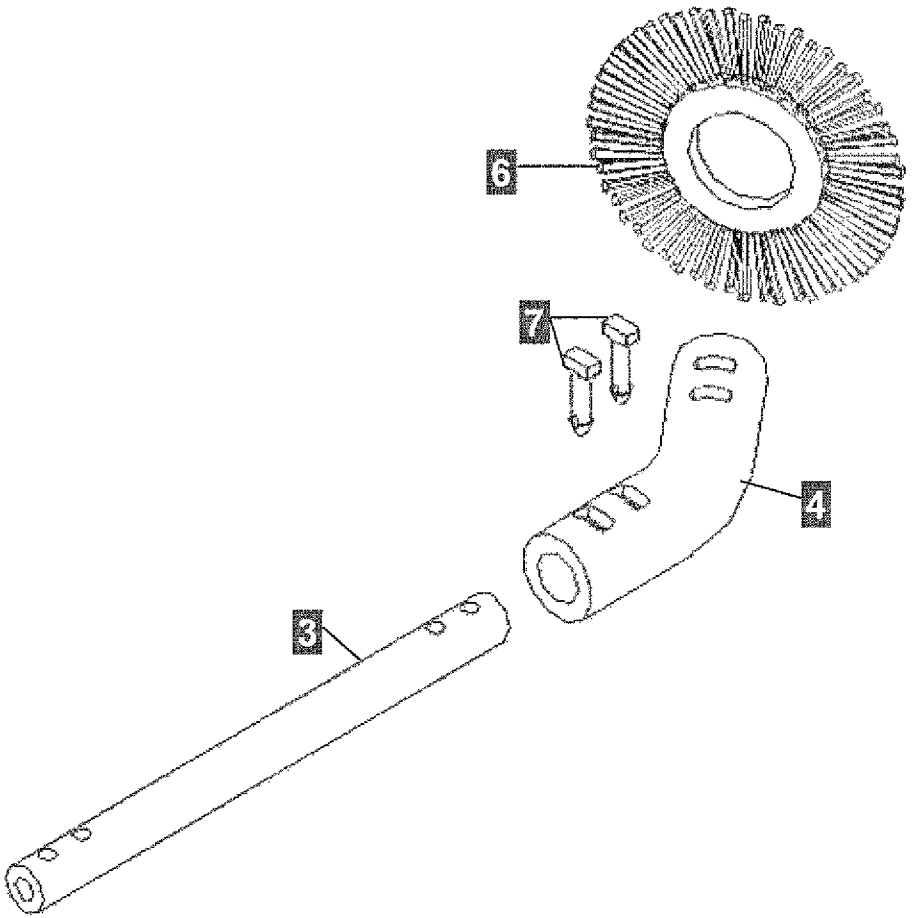
FIG. 4 shows details of a single-plane connector assembly with countersunk holes and self-cleaning discs.
Figure 5:
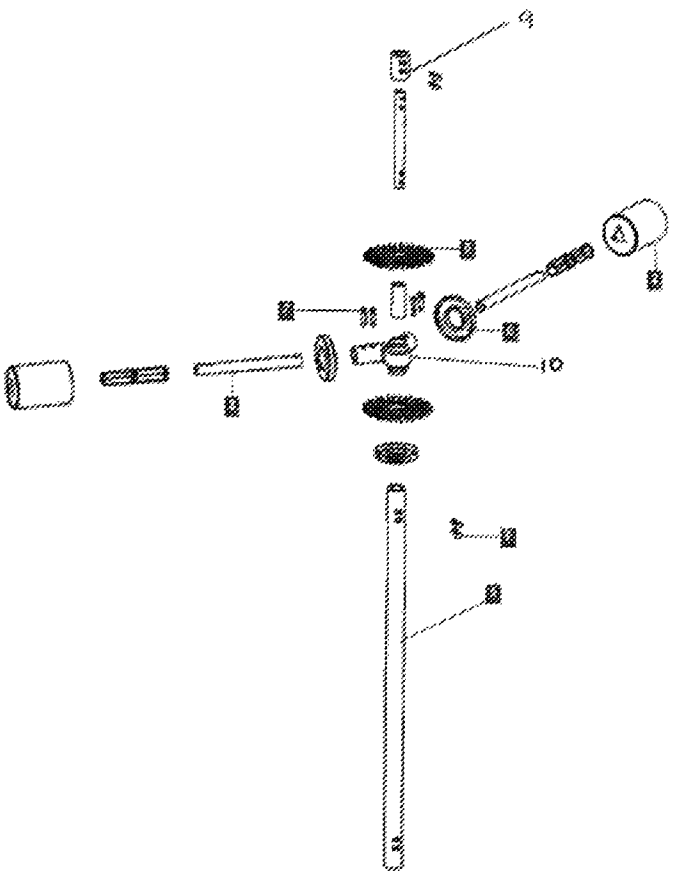
FIG. 5 shows details of the multiple-plane Connector Assembly with moving and fixed self-cleaning rings.

1 Ring collar
2 Rollers
3 Roller shafts
4 Single ring connector
5 Linkage pipe
6 Self-cleaning disc
7 Locking pin
8 Fixed self-cleaning ring
9 Lock shaft
10 Multiple ring connector

BEST MODES FOR CARRYING OUT THE INVENTION

Figure 6:
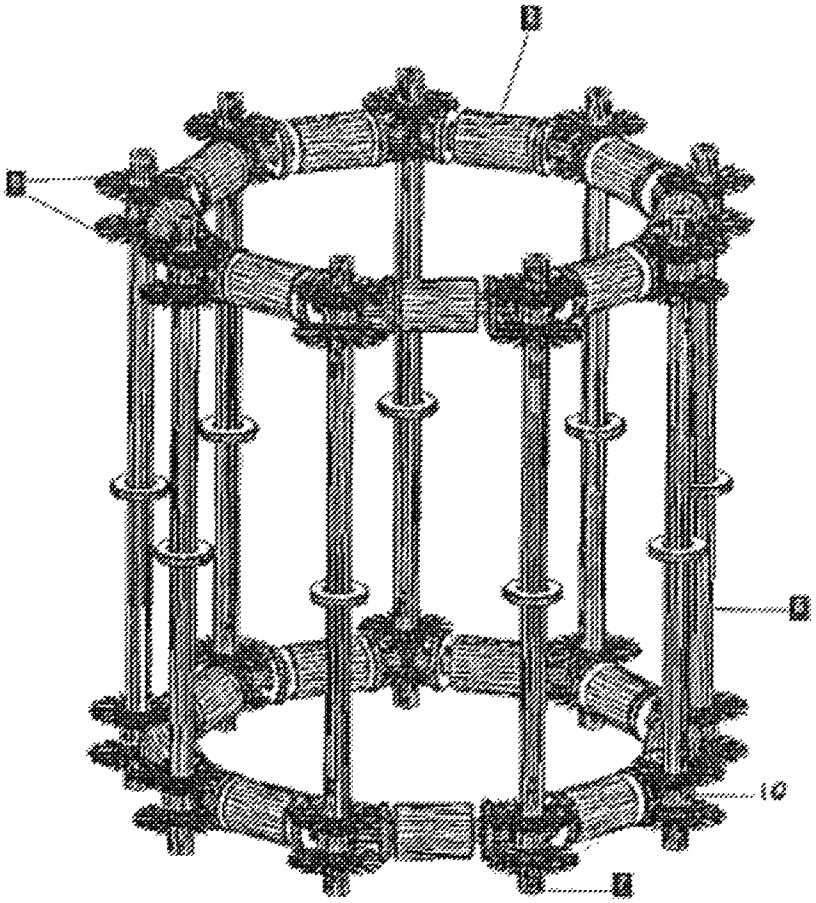
FIG. 6 shows a typical assembly of a multiple-ring apparatus used for marine growth prevention and to withstand impact according to the present invention.
Figure 7:
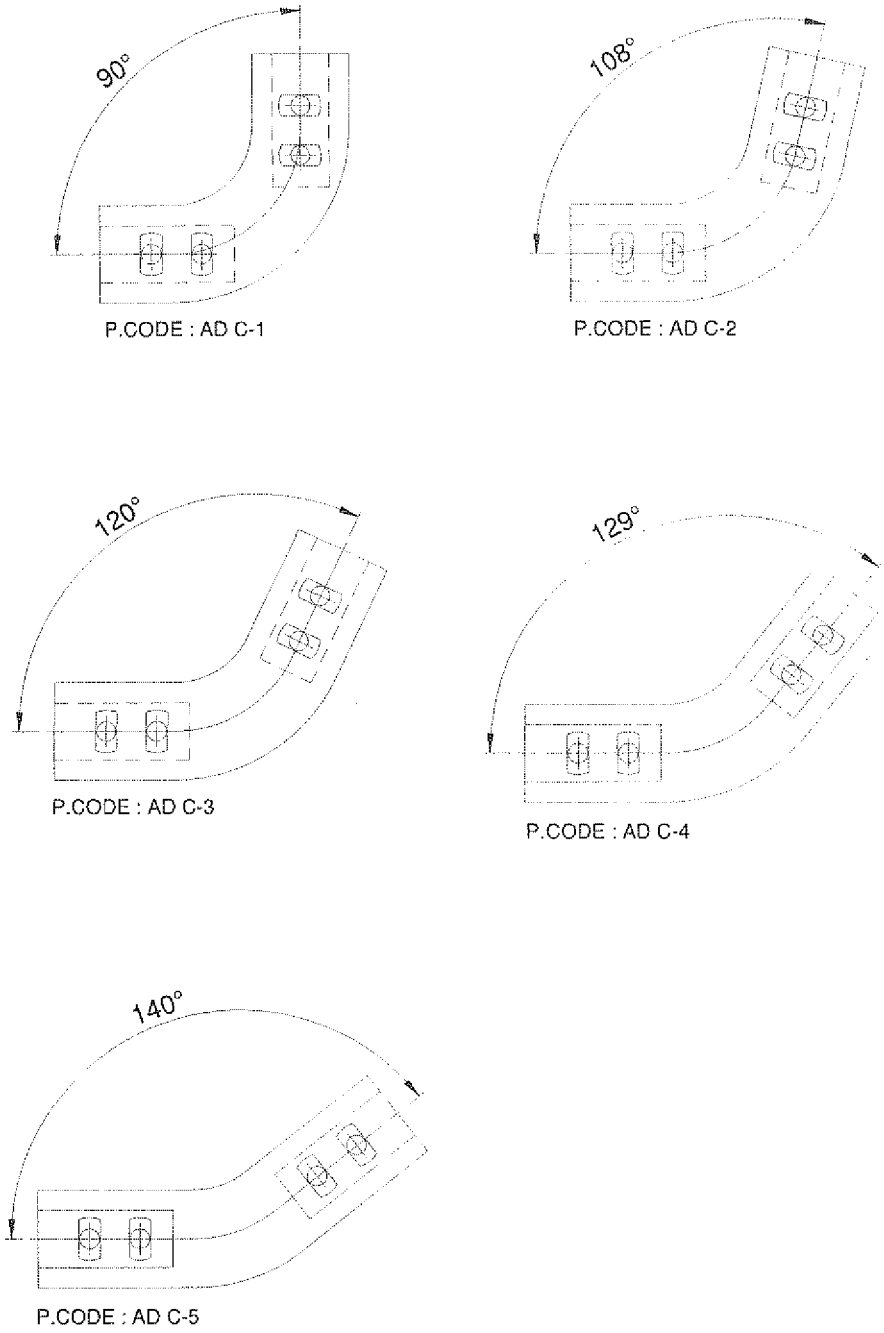
FIG. 7 shows connector design with multiple pre-determined angles for a single ring apparatus.

The apparatus as shown in FIGS. 1 and 6 and is a wave-driven apparatus, adapted to be installed around submerged structural components for preventing growth of marine fouling. The apparatus comprises at least one ring used individually (as shown in FIG. 1) or in a series held together with linking members to form a cage (as shown in FIG. 6).

In an embodiment, the rings of apparatus 1 are connected together, in spaced-apart array, as seen in FIG. 6, by means of tubular linking members (5). The tubular members are disposed substantially parallel to the submerged structural member which is surrounded by the flexible collars. Each linking member (5) has, mounted for rotation on it, at least one moving self-cleaning disc (6) which can freely rotate and move in an upwardly or downwardly direction. The roller disks are preferably made of high density plastic with a layer of soft material such as composite rubber or the like to serve as a component that is slightly positive buoyant. The constant movement of the self-cleaning disc (6) along the linking member is to maintain each linking member free of marine growth.

In a preferred embodiment of the invention, the individual or a series of rings, are provided with a plurality of rollers (2) linked together to constitute a collar. The roller (2) of the current embodiment is preferably made of a material that is resistant to wear and abrasion. In addition to durability, the roller (2) is also preferably made of a material that has a cushioning effect to absorb impact forces such as rubber and the like, when the roller (2) is used on submerged structures which are coated with paint, wrapped with corrosion prevention tape and others. When used on submerged structures without any form of coating on the surface or tape wrap and others, the roller (2) is preferably made of material that is highly resistant to abrasion and impact such as High Density poly Ethylene, Ralloy, Teflon and the like.

Each roller (2) is freely rotatable about a roller shaft (3). The roller shafts (3) of the ring are linked together by a fixed connector (4, 10). Each connector (4, 10) is designed with a pre-determined angle to encircle pillars with a certain diameter range. The connector (4, 10) is linked with roller shafts (3) at either ends by locking pins (7) via two countersunk holes at each end.

Two types of connectors (4, 10) are envisaged, one connects with roller shafts (3) on horizontal plane for the single-ring apparatus in FIG. 1 and the other connects both roller shafts (3) on horizontal plane and linkage pipe (5) on vertical plane for the multiple-ring apparatus in FIG. 6 respectively. To keep the single ring connector (4) in FIG. 1 and multiple ring connector (10) in FIG. 6 free of marine growth settlement, one or more self-cleaning discs (6) are mounted on the connector. The relative movement of the self-cleaning aid over the body of connector (4, 10) will keep the connector (4, 10) clean and the random contact between the sides of self-cleaning disc (6) and the end of roller (2) will also keep all surfaces free of marine growth settlement. To keep the multiple ring connector (10) in FIG. 6 free of marine growth, an additional fixed self-cleaning rings (8) with long flexible bristles will be installed and the sweeping motion of the bristles over the surface of the multiple ring connector (10) will keep its surface free of marine growth settlement.

In summary, the apparatus comprising a single or multiple ring configuration which is slightly positive buoyant in nature when surrounding a submerged structure will have constant upwardly and downwardly movement along the submerged structure according to the movement of the ocean surface in the like of waves, tidal fluctuations and swells will prevent any growth of marine fouling on the submerged structure. The apparatus is suitable to be installed in areas with rough sea conditions such as in typhoon prone areas and the like.

While the above invention has been described in terms of several embodiments, those of ordinary skilled in the art will recognize that the invention is not limited to the embodiments described, but can be practiced with modification and alteration within the meaning and scope of the appended claims.

The invention claimed is:

1. An apparatus to be installed around structural marine components, comprising:
- a plurality of freely rotatable rollers disposed on a plurality of roller shafts;
- the plurality of roller shafts linked together by single ring connectors to form a ring collar; and,
- a plurality of self-cleaning discs mounted directly on the single ring connectors.

2. The apparatus according to claim 1, wherein the plurality of self-cleaning discs freely rotating and moving back and forth along the single ring connector.

3. The apparatus according to claim 1, wherein the plurality of self-cleaning discs each comprises HDPE or a combination of HDPE and rubber sleeve.

4. The apparatus according to claim 1, wherein each of the single ring connectors comprises a tube with opened ends for insertion of adjacent roller shafts at the ends by locking pins via countersunk holes.

5. An apparatus to be installed around structural marine components, comprising:
- a plurality of ring collars, each ring collar comprising a plurality of freely rotatable rollers disposed on a plurality of roller shafts (3),
- the plurality of roller shafts linked together by multiple ring connectors to form the ring collar;
- a plurality of tubular linkage pipes connecting to the multiple ring connectors to connect the plurality of ring collars in parallel to form a cage; and
- a plurality of self-cleaning discs mounted directly on the multiple ring connectors and the linkage pipes.

6. The apparatus according to claim 5, wherein the plurality of fixed self-cleaning discs freely rotatable around a lock shaft and placed above and under the multiple ring connectors and the plurality of self-cleaning discs freely rotatable and movable back and forth along the surface of the connectors or movable up and down along the linkage pipes.

7. The apparatus according to claim 5, wherein the plurality of self-cleaning discs each comprises HPDE or a combination of HDPE and rubber sleeve.

8. The apparatus according to claim 5, wherein each of the multiple ring connectors comprises a tube with opened ends for insertion of adjacent roller shafts at the ends by locking pins via countersunk holes.

9. An apparatus to be installed around structural marine components comprising:

a plurality of freely rotatable rollers disposed on a plurality of roller shafts;

the plurality of roller shafts linked together by single ring connectors to form a ring collar; and a plurality of self-cleaning discs mounted directly on the single ring connectors, wherein each single ring connector is a multiple-angle fixed connector.

10. The apparatus according to claim 9, wherein each single ring connector is moulded to predetermined angles to enable the ring collar to encircle the structural marine components.

11. The apparatus according to claim 9, wherein each single ring connector is linked with roller shafts at either ends by locking pins via countersunk holes at each end.

12. The apparatus according to claim 9, wherein the plurality of self-cleaning discs are freely rotatable and movable back and forth along the fixed connector.

13. The apparatus according to claim 9, wherein each of the plurality of self-cleaning discs comprises HDPE or a combination of HDPE and rubber sleeve.

14. An apparatus to be installed around structural marine components, comprising:

a plurality of ring collars, each ring collar comprising a plurality of freely rotatable rollers (2) disposed on a plurality of roller shafts (3), the plurality of roller shafts (3) linked together by multiple ring connectors to form a ring collar;

a plurality of tubular linkage pipes connecting to the multiple ring connectors to connect the plurality of ring collars in parallel to form a cage; and a plurality of self-cleaning discs mounted directly on the multiple ring connectors and the linkage pipes;

wherein each multiple ring connector is a multiple-angle fixed connector with multiple arms connecting adjacent roller shafts on a horizontal plane and pipes on a vertical plane.

15. The apparatus according to claim 14, wherein each of the multiple ring connectors is moulded to predetermined angles to enable the cage to encircle a protected structure.

16. The apparatus according to claim 14, wherein each of the multiple ring connector is linked with roller shafts at either ends by locking pins via countersunk holes at each end, and the pipe is linked with the multiple ring connector of a parallel ring collar via a vertical arm of the multiple ring connector.

17. The apparatus according to claim 14, wherein the plurality of self-cleaning discs are freely rotatable and movable back and forth along the surface of the multiple ring connectors and movable up and down along the linkage pipes.

18. The apparatus according to claim 14, wherein each of the plurality of self-cleaning discs comprises HDPE or a combination of HDPE and rubber sleeve.

19. The apparatus according to claim 14, wherein the plurality of self-cleaning discs freely rotate on either sides of a vertical arm of the multiple ring connector.

20. The apparatus according to claim 19, wherein each of the plurality of self-cleaning discs comprises long flexible bristles to continuously sweep over the surface of the multiple ring connectors.

* * * * *